US010624195B2

(12) United States Patent
Steck et al.

(10) Patent No.: US 10,624,195 B2
(45) Date of Patent: Apr. 14, 2020

(54) TRI-AXIS X-RAY TUBE

(71) Applicant: Moxtek, Inc., Orem, UT (US)

(72) Inventors: Ricky B. Steck, West Jordan, UT (US); Brad Harris, Farmington, UT (US)

(73) Assignee: Moxtek, Inc., Orem, UT (US)

( * ) Notice: Subject to any disclaimer, the term of this patent is extended or adjusted under 35 U.S.C. 154(b) by 7 days.

(21) Appl. No.: 16/144,113

(22) Filed: Sep. 27, 2018

(65) Prior Publication Data

US 2019/0132936 A1 May 2, 2019

Related U.S. Application Data

(60) Provisional application No. 62/577,276, filed on Oct. 26, 2017.

(51) Int. Cl.

| | |
|---|---|
| ***H05G 1/02*** | (2006.01) |
| ***H01J 35/08*** | (2006.01) |
| ***H05G 1/10*** | (2006.01) |
| ***H01J 35/18*** | (2006.01) |
| ***H01J 35/06*** | (2006.01) |

(52) U.S. Cl.

CPC ..... *H05G 1/02* (2013.01); *H01J 35/06* (2013.01); *H01J 35/08* (2013.01); *H01J 35/18* (2013.01); *H05G 1/10* (2013.01)

(58) Field of Classification Search

None

See application file for complete search history.

(56) References Cited

U.S. PATENT DOCUMENTS

| | | | | |
|---|---|---|---|---|
| 3,689,790 | A | 9/1972 | Haas et al. | |
| 3,753,020 | A | 8/1973 | Zingaro | |
| 9,177,755 | B2 | 11/2015 | Parker et al. | |
| 9,184,020 | B2 | 11/2015 | Parker | |
| 2011/0135066 | A1 | 6/2011 | Behling | |
| 2014/0247921 | A1* | 9/2014 | Parker | H01J 35/28 378/125 |
| 2015/0110252 | A1* | 4/2015 | Yun | G21K 1/06 378/138 |
| 2015/0303024 | A1 | 10/2015 | Harker et al. | |
| 2016/0133429 | A1 | 5/2016 | Kawase | |

FOREIGN PATENT DOCUMENTS

| | | |
|---|---|---|
| CN | 103245445 | 8/2013 |
| JP | 2001-023557 A | 1/2001 |
| JP | 2008-300118 A | 12/2008 |
| JP | 2015-173045 | 10/2015 |

* cited by examiner

*Primary Examiner* — Hoon K Song

(74) *Attorney, Agent, or Firm* — Thorpe, North & Western, LLP

(57) ABSTRACT

In one embodiment, an x-ray tube 15 can be used closer to a sample. An angle $A_1$ between an anode axis 02 and an electron-beam axis 01 can be ≥10° and ≤80° and an angle $A_2$ between the anode axis 02 and an x-ray axis 03 can be ≥10° and ≤80°. In another embodiment, a cap 20 on an anode 12 can block x-rays emitted in undesired directions. The cap 20 can include an internal cavity 24, an electron-beam hole 21, an anode hole 22, and an x-ray hole 23. In another embodiment, an electrical connection between an x-ray tube 15 and a power supply 18 can be reliable and easy to manufacture. The anode 12 can include a hole 31 at an end of the anode 12 sized and shaped for insertion of an electrical connector 32.

20 Claims, 5 Drawing Sheets

TRI-AXIS X-RAY TUBE

CLAIM OF PRIORITY

Figure 1:
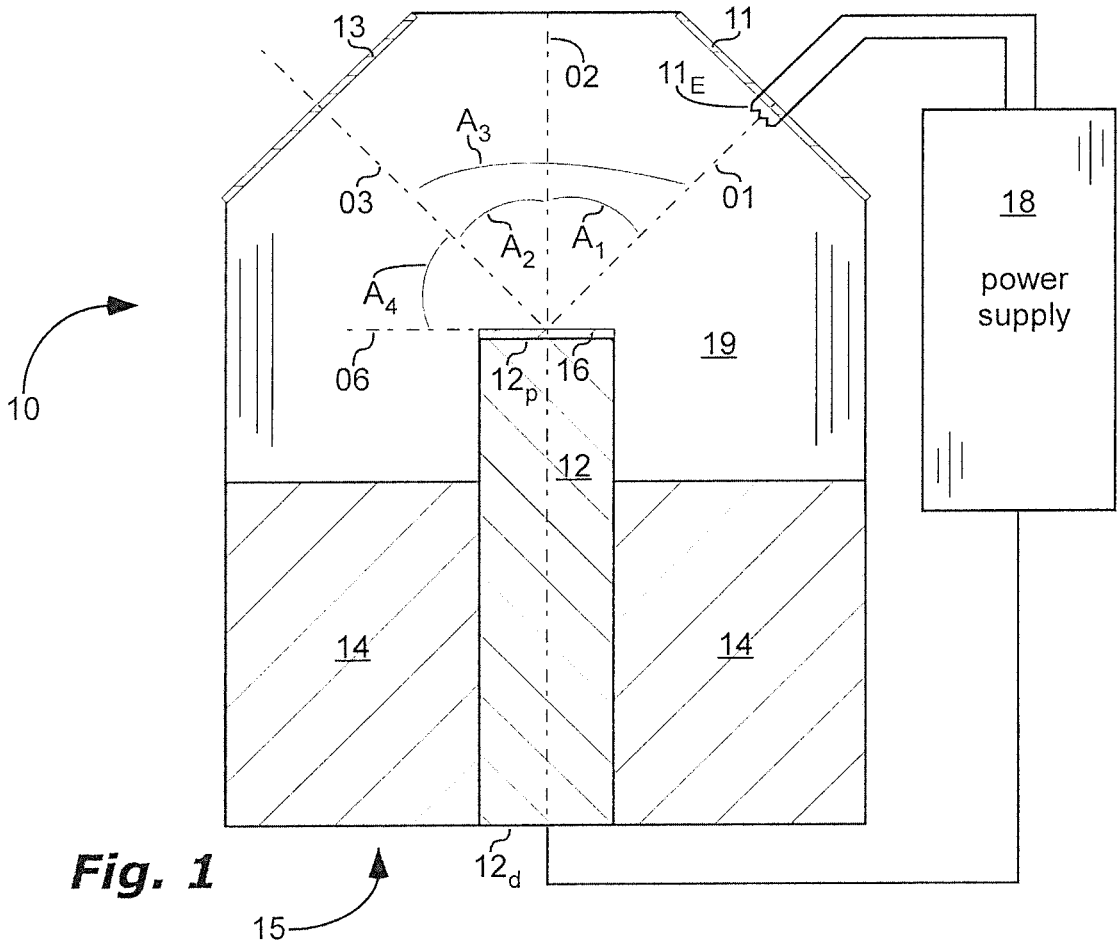

This application claims priority to U.S. Provisional Patent Application No. 62/577,276, filed on Oct. 26, 2017, which is incorporated herein by reference.

FIELD OF THE INVENTION

The present application is related generally to x-ray sources.

BACKGROUND

In some applications, it can be important for the x-ray tube to be located close to a sample. This is particularly important if small spot size is important (e.g. microfocus x-ray tubes). The structure of the x-ray tube combined with space needed for a detector for analysis of fluoresced x-rays can make it difficult to have the desired distance to the sample. It would be beneficial the distance between the x-ray tube and the sample could be minimized.

In an x-ray tube, in response to impinging electrons from an electron emitter, a target material portion of an anode can emit x-rays in all directions. It can be important for safety considerations to block x-rays emitted in undesired directions. It can be important for cost saving and weight reduction to minimize the weight of material used for blocking such x-rays.

An x-ray source includes an x-ray tube electrically coupled to a power supply. Because the power supply can provide many kilovolts of differential voltage to the x-ray tube, this electrical coupling/electrical connection can be important and careful design is needed for proper electrical connection without undesirable arcing. Furthermore, because the design typically will need to be repeated many times as many such x-ray sources are made, ease of manufacture is another consideration.

SUMMARY

It has been recognized that it would be advantageous to have a minimal distance between the x-ray tube and a sample; to block x-rays emitted by an x-ray tube in undesired directions with minimal weight of material used for blocking such x-rays; and to provide an electrical connection between an x-ray tube and a power supply that is reliable (i.e. not prone to arcing failure) and relatively easy to manufacture. The present invention is directed to various embodiments of x-ray tubes and x-ray sources that satisfy these needs. Each embodiment may satisfy one, some, or all of these needs.

The x-ray tube can comprise a cathode and an anode electrically insulated from one another, the anode including a proximal end closer to the cathode and a distal end farther from the cathode and an x-ray window configured to allow transmission of x-rays, the x-ray window spaced apart from the anode. The cathode can be configured to emit electrons in an electron beam towards the anode. The anode can include target material at the proximal end configured to emit x-rays in response to impinging electrons from the cathode. The x-rays can be emitted in an x-ray beam through an internal cavity of the x-ray tube to and through the x-ray window.

In one embodiment of the x-ray tube in paragraph two of this summary section, an axis along a longest dimension of the anode defines an anode axis, an axis along a center of the electron beam defines an electron-beam axis, and an axis perpendicular to a plane of the x-ray window and along a center of the x-ray beam defines an x-ray axis. An angle between the anode axis and the electron-beam axis can be ≥10° and ≤80° and an angle between the anode axis and the x-ray axis can be ≥10° and ≤80°.

In another embodiment of the x-ray tube in paragraph two of this summary section, the x-ray tube can further comprise a cap on the proximal end of the anode. The cap can include an internal cavity, defining a cap cavity; a first hole, defining an electron-beam hole, extending from an exterior of the cap to the cap cavity along the electron-beam axis; a second hole, defining an anode hole, extending from the exterior of the cap to the cap cavity along the anode axis, the anode located in the anode hole with the target material facing the cap cavity; and a third hole, defining an x-ray hole, extending from the exterior of the cap to the cap cavity along the x-ray axis.

In another embodiment of the x-ray tube in paragraph two of this summary section, the anode can include a hole at the distal end of the anode, defining an anode cavity. The anode cavity can be sized and shaped for insertion of an electrical connector.

BRIEF DESCRIPTION OF THE DRAWINGS (DRAWINGS MIGHT NOT BE DRAWN TO SCALE)

FIG. 1 is a schematic, cross-sectional side-view of an x-ray source 10 comprising a power supply 18 and an x-ray tube 15, the x-ray tube including an electron-beam axis 01, an anode axis 02, and an x-ray axis 03, in accordance with an embodiment of the present invention.

Figure 2:
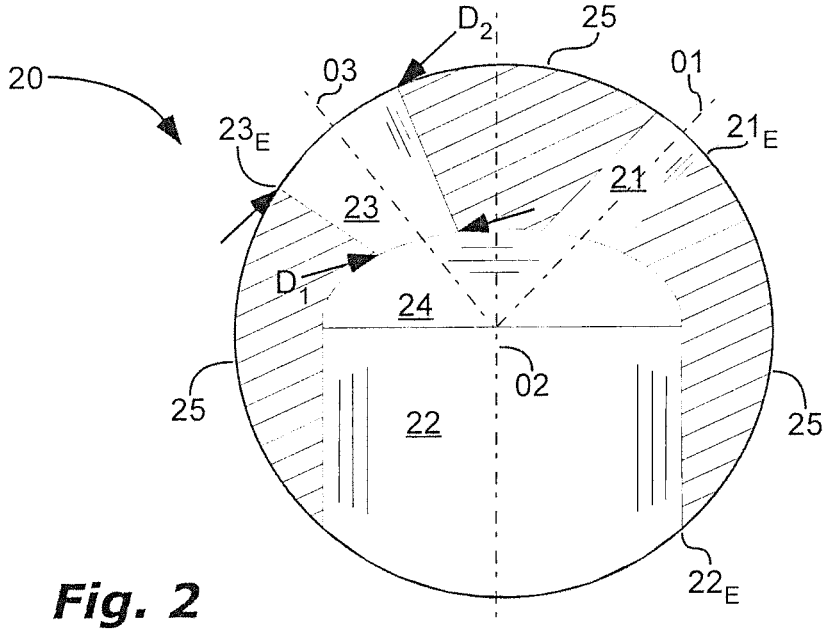

FIG. 2 is a schematic, cross-sectional side-view of a cap 20 for the anode 12, including a cap cavity 24, an electron-beam hole 21, extending from an exterior 25 of the cap 20 to the cap cavity 24 along the electron-beam axis 01, an anode hole 22 extending from the exterior 25 of the cap 20 to the cap cavity 24 along the anode axis 02, and an x-ray hole 23 extending from the exterior 25 of the cap 20 to the cap cavity 24 along the x-ray axis 03, in accordance with an embodiment of the present invention.

Figure 3:
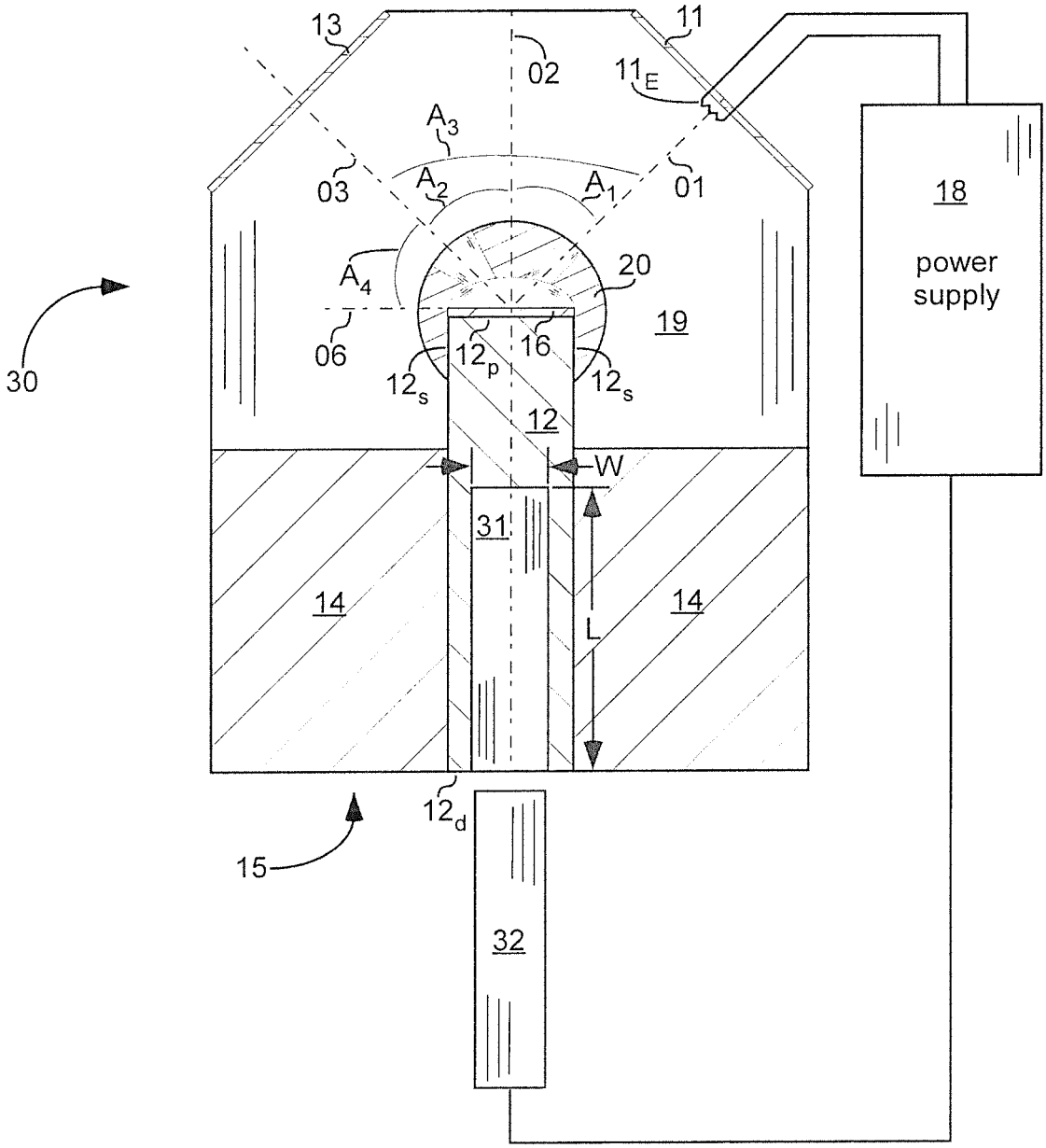

FIG. 3 is a schematic, cross-sectional side-view of an x-ray source 30, similar to the x-ray source 10, further comprising the anode 12 in the anode hole 22 of the cap 20 and an anode cavity 31 in the anode 12 with a matching electrical connector 32, in accordance with an embodiment of the present invention.

Figure 4:
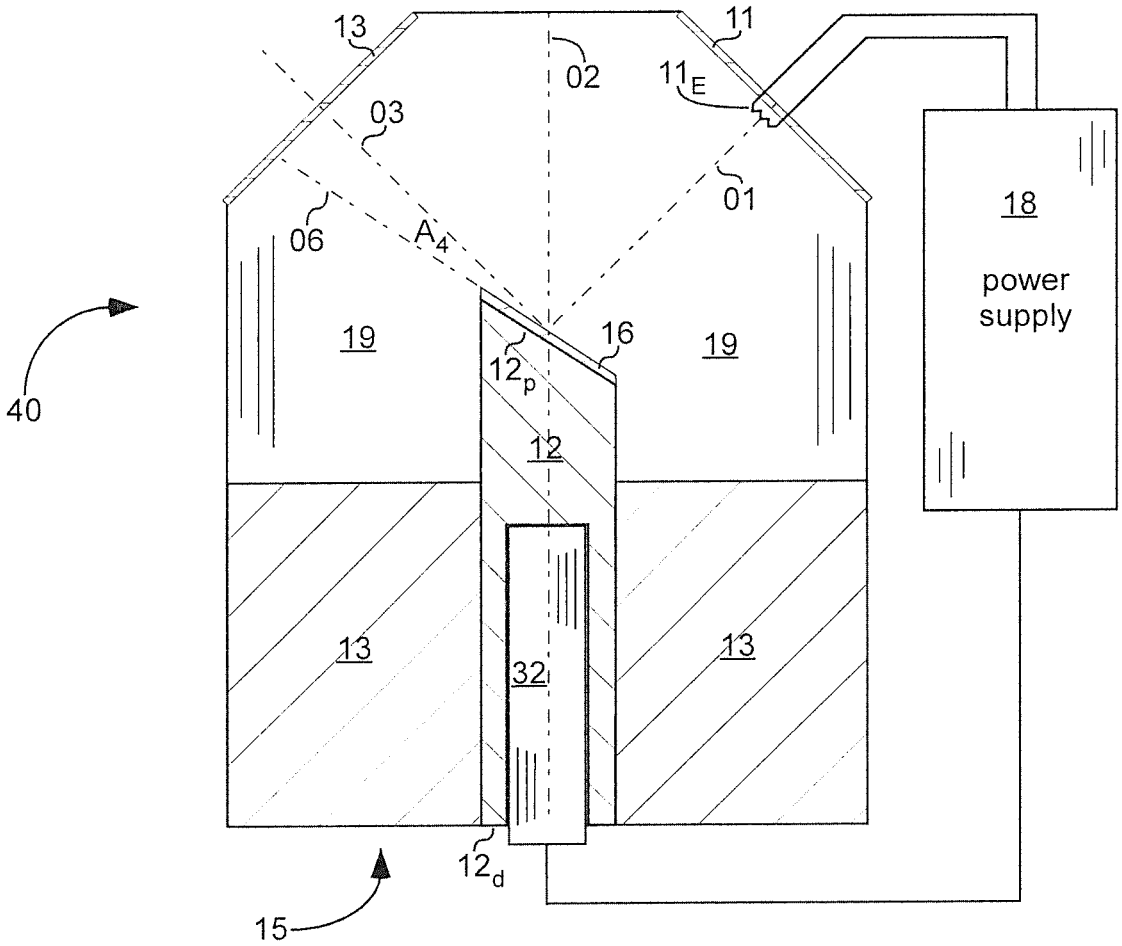

FIG. 4 is a schematic, cross-sectional side-view of an x-ray source 40, similar to the x-ray sources 10 and 30, further comprising a face of the anode 12 with the target material 16 tilted towards the an electron emitter $\mathbf{11}_E$ to form an angle $A_4$ of <90° between a plane 06 of the face of the anode 12 and the x-ray axis 03, in accordance with an embodiment of the present invention.

Figure 5:
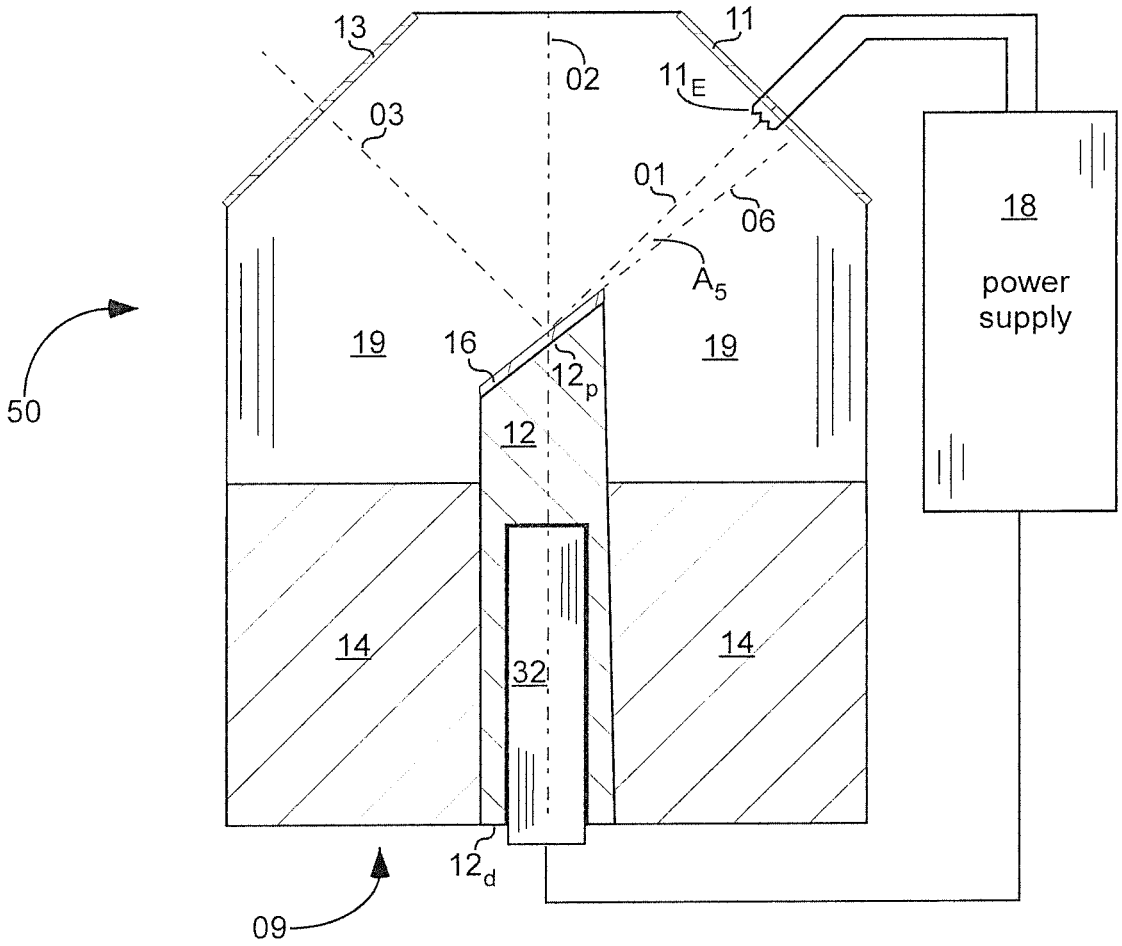

FIG. 5 is a schematic, cross-sectional side-view of an x-ray source 50, similar to the x-ray sources 10 and 30, further comprising the face of the anode 12 with the target material 16 tilted towards the x-ray window 13 to form an angle $A_5$ of <90° between the plane 06 of the face of the anode 12 and the electron-beam axis 01, in accordance with an embodiment of the present invention.

Figure 6:
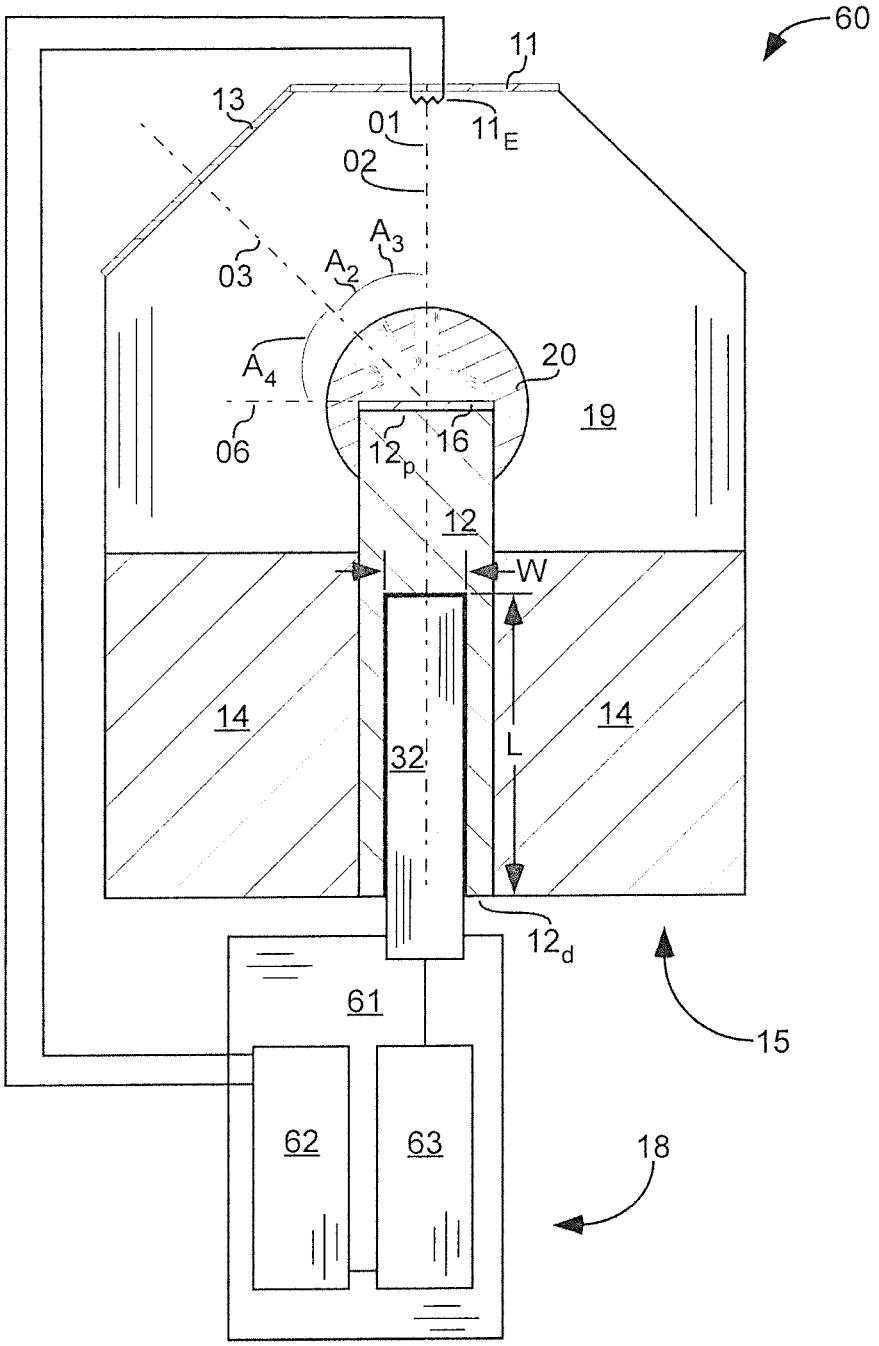

FIG. 6 is a schematic, cross-sectional side-view of an x-ray source 60, similar to the x-ray sources 10, 30, 40, and 50, but showing added details of the power supply 18, in accordance with an embodiment of the present invention.

DETAILED DESCRIPTION

As illustrated in FIG. 1, an x-ray source 10 is shown comprising a power supply 18 electrically coupled to an x-ray tube 15 and configured to provide electrical power to the x-ray tube. The power supply 18 can be battery operated, and the x-ray source 10 can be portable with a small weight (e.g. ≤1 kg, ≤2 kg, ≤3 kg, ≤4 kg, or ≤6 kg). As used herein, the term "kg" means kilogram.

The x-ray tube 15 can comprise a cathode 11 and an anode 12 electrically insulated from one another. This electrical insulation can include a solid or liquid electrically insulative material 14 (e.g. electronic potting compound) and an evacuated internal cavity 19 of the x-ray tube 15. The anode can include a proximal end $12_p$ closer to the cathode 11 and a distal end $12_d$ farther from the cathode 11.

An x-ray window 13 can form at least part of an exterior wall of the x-ray tube. The x-ray window 13 can include some or all of the properties (e.g. low deflection, high x-ray transmissivity, low visible and infrared light transmissivity) of the x-ray windows described in U.S. Patent Publication Number 2015/0303024, which is incorporated herein by reference in its entirety. The x-ray window 13 can be spaced apart from the anode 12; thus, the x-ray tube 15 can be a side-window x-ray tube 15. The x-ray window 13 can be electrically insulated from the anode 12. The x-ray window 13, the anode 12, or both can be connected to ground.

The cathode 11 can be configured to emit electrons from an electron emitter $11_E$ in an electron beam towards the anode 12. The anode 12 can include a target material 16 at the proximal end $12_p$ configured to emit x-rays in response to impinging electrons from the cathode 11. The x-rays can be emitted in an x-ray beam through an internal cavity of the x-ray tube 10 to and through the x-ray window 13.

The x-ray tube 15 can include an axis along a center of the electron beam, defining an electron-beam axis 01; an axis along a longest dimension of the anode 12, defining an anode axis 02; and an axis along a center of the x-ray beam, which can be perpendicular to a plane of the x-ray window 13, defining an x-ray axis 03. Emitted x-rays can be directed towards a sample. The sample can then fluoresce x-rays that will be collected in and analyzed by an x-ray detector. Space is needed for emission of the x-rays to the sample and the fluoresced x-rays to the detector. If a small x-ray spot on the sample is desirable, then it can be important to minimize this space and thus minimize undesirable expansion of the x-ray beam. Proper selection of angles $A_1$, $A_2$, and $A_3$ between the electron-beam axis 01, the anode axis 02, and the x-ray axis 03 can allow minimization of this space. X-ray sources 10, 30, 40, and 50 in FIGS. 1 and 3-5 with $A_1 \approx 45°$, $A_2 \approx 45°$, and $A_3 \approx 90°$ can allow the x-ray tube 15 to be located closer to a sample compared to x-ray source 60 in FIG. 6 with $A_1 \approx 0°$, $A_2 \approx 45°$, and $A_3 \approx 45°$. The x-ray source 60 in FIG. 6 with $A_1 \approx 0°$, $A_2 \approx 45°$, and $A_3 \approx 45°$ can be beneficial for other applications and can be preferred for ease of manufacturing.

Examples of angles of the embodiment in FIGS. 1 and 3-5 include: an angle $A_1$ between the electron-beam axis 01 and the anode axis 02 of ≥10°, ≥20°, ≥30°, or ≥40° and ≤50°, ≤60°, ≤70°, or ≤80°; an angle $A_2$ between the anode axis 02 and the x-ray axis 03 of ≥10°, ≥20°, ≥30°, or ≥40° and ≤50°, ≤60°, ≤70°, or ≤80°; and an angle between the electron-beam axis 01 and the x-ray axis 03 of ≥20°, ≥40°, ≥60°, or ≥80°, and ≤100°, ≤120°, ≤140°, or ≤160°. $A_1$ plus $A_2$ can equal $A_3$.

A cap 20 for the anode 12 is shown in FIG. 2. The cap 20 can include an internal cavity, defining a cap cavity 24. A first hole in the cap 20, defining an electron-beam hole 21, can extend from an exterior 25 of the cap 20 to the cap cavity 24 along the electron-beam axis 01. A second hole in the cap 20, defining an anode hole 22, can extend from the exterior 25 of the cap 20 to the cap cavity 24 along the anode axis 02. A third hole in the cap 20, defining an x-ray hole 23, can extend from the exterior 25 of the cap 20 to the cap cavity 24 along the x-ray axis 03. As shown in FIGS. 3 and 6, the proximal end $12_p$ of the anode 12 can be located in the anode hole 22 with the target material 16 facing the cap cavity 24. The cap 20 can extend along sides $12_s$ of the anode from the proximal end $12_p$ towards the distal end $12_p$ of the anode 12.

The cap 20 and the anode 12 can comprise material and thicknesses to block x-rays in undesired directions. Because the cap 20 is located very close to the target material 16 and thus close to the source of x-rays, its size can be smaller than shielding that blocks x-rays farther from the source. The anode 12 can block x-rays emitted into the anode hole 22. In order to block the x-rays, the cap 20 and/or the anode 12 can have a high weight percent of materials having a high atomic number. Thus, the cap 20, the anode, or both can have at least 25 weight percent, at least 50 weight percent, at least 75 weight percent, or at least 90 weight percent of materials having an atomic number of at least 42, at least 72, or at least 74. The cap 20 and the anode 12 can have a material composition and thickness to block at least 90%, at least 99%, or at least 99.9% of x-rays emitted from the target material 16 that do not pass through the electron-beam hole 21 or the x-ray hole 23. The cap 20 and the anode 12 can thus block x-rays in all undesired directions except for the electron-beam hole 21. In order to properly block x-rays and avoid a thermal expansion mismatch, a material composition of the cap 20 can be the same as a material composition of the anode 12.

The x-ray hole 23 of the cap 20 can have an expanding size to allow expansion of x-rays that pass through the x-ray hole 23. For example, a largest dimension $D_2$ of the x-ray hole 23 at the exterior 25 of the cap 20 can be at least 1.2 times larger, at least 1.5 times larger, or at least 2 times larger than a largest dimension $D_1$ of the x-ray hole 23 at the cap cavity 24. These largest dimensions $D_1$ and $D_2$ can be widths or diameters.

The x-ray hole 23 of the cap 20 can shape the emitted x-ray beam. Thus for example, all or part of the x-ray hole 23 can have a rounded shape (e.g. circular, ellipse, etc.), a square shape, or a rectangular shape. Each application of the x-ray sources 10, 30, 40, 50, and 60 described herein may need its own shape of emitted x-ray beam.

Sharp points or sharp edges at the exterior 25 of the cap 20 can result in large voltage gradients adjacent to such points or edges, which can result in malfunctioning of the x-ray tube 15. In order to avoid such large voltage gradients, the exterior 25 of the cap 20 can comprise or consist of smooth curves. For example, the exterior 25 of the cap 20 can have a spherical shape or some other rounded convex shape. Exceptions to the smooth curvature can include an entrance $21_E$ to the electron-beam hole 21, an entrance $22_E$ to the anode hole 22, an entrance 23E to the x-ray hole 23, or combinations thereof.

It can be helpful for the anode 12 to have a low coefficient of thermal expansion for minimal movement of the x-ray spot as the anode changes temperature. Thus for example, the anode 12 can have a coefficient of thermal expansion of ≤20 m/(m*K), ≤15 m/(m*K), ≤12 m/(m*K), or ≤10 m/(m*K). It can be helpful for the anode 12 to have a high thermal conductivity for transfer of heat away from the target material 16. Thus for example, the anode 12 can have a thermal conductivity of ≥50 W/(m*K), ≥100 W/(m*K), ≥140 W/(m*K), ≥160 W/(m*K), or ≥180 W/(m*K).

One potential anode material is tungsten copper, which can be a metal matrix composite. This material combines the high thermal conductivity of copper with the high atomic number and the low coefficient of thermal expansion of tungsten. For example, a material composition of the anode can include at least 50%, at least 60%, at least 70%, at least 80%, or at least 90% tungsten; and/or at least 1%, at least 5%, at least 10%, at least 15%, or at least 20% copper.

A plane 06 of a face of the anode 12 with the target material 16 can be beveled, forming an acute angle with respect to the anode axis 02, which can change a shape of an x-ray spot on the sample. This shape can be elongated in one of two different directions, each direction at 90° with respect to each other, by changing this angle. For example, as shown in FIG. 4, an angle $A_4$ between the plane 06 of the face of the anode 12 and the x-ray axis 03 can be ≥1°, ≥2°, ≥5°, or ≥15° and ≤20°, ≤30°, or ≤40°. As another example, as shown in FIG. 5, for elongation of the spot in a direction 90° from the direction of FIG. 4, an angle $A_5$ between the plane 06 of a face of the anode 12 with respect to the electron-beam axis 01 can be ≥1°, ≥2°, ≥5°, or ≥15° and ≤20°, ≤30°, or ≤40°.

As shown in FIG. 3, the anode 12 can include a hole at a distal end of the anode 12 farther from the cathode 11, defining an anode cavity 31. The anode cavity 31 can be sized and shaped for insertion of an electrical connector 32. In FIGS. 4-6, the electrical connector 32 is shown inserted into the anode cavity 31. The electrical connector 32 provides an electrical coupling to the power supply 18. The anode 12 can be electrically conductive from the target material 16 to the anode cavity 31 to allow electrical current to flow from the electrical connector 32 in the anode cavity 31 to the target material 16. The anode cavity 31 and the electrical connector 32 can mate to form a reliable and easy to manufacture electrical connection. The anode cavity 31 and the mating electrical connector 32 can each have a cylindrical shape for easier manufacturing.

A length L (in a direction parallel to the anode axis 02) and width W (in a direction perpendicular to the anode axis 02) of the anode cavity 31 can be selected for optimal strength of the anode 12 and area of electrical contact between the anode 12 and the electrical connector 32. For example, the length L can be ≥3 mm, ≥3 mm, ≥5 mm, or ≥10 mm and ≤15 mm, ≤30 mm, ≤100 mm, or ≤200 mm. For example, the width W can be ≥0.5 mm, ≥1 mm, ≥2 mm, or ≥2.5 mm and ≤3.5 mm, ≤5 mm, or ≤10 mm. As used herein, the term "mm" means millimeter. The actual width W and length L can depend on the actual size of the anode 12.

As shown in FIG. 6, the power supply 18 can include the electrical connector 32 rigidly connected to and extending from a circuit board 61 into the anode cavity 31 and making electrical contact with the anode 12. The circuit board 61 can include a voltage multiplier circuit 63 configured to provide electrical power to the electrical connector 32 with a high voltage (e.g. ≥1 kilovolt, ≥4 kilovolts, or ≥10 kilovolts). A control circuit 62 can control and provide input electrical power to the voltage multiplier circuit 63. An advantage of this design is that the circuit board can provide support for the electrical connector 32 and the x-ray tube 15; consequently mounting bolts for the circuit board 61 can be avoided or located far from high voltage components, thus reducing the risk of arcing failure. For example, if mounting bolts for the circuit board 61 are used, there can be a distance of ≥25 mm, ≥40 mm, or ≥80 mm between any part of the voltage multiplier circuit 63, having a voltage differential of at least 5000 volts with respect to ground, and a mounting bolt at ground voltage.

An alternative to the electrical connector 32 being rigidly connected to and extending from the circuit board 61 is for the electrical connector 32 to be electrically coupled to the circuit board 61 by a flexible cable. A choice of the rigid mounting or the cable can be made depending on the final use of the x-ray source. A cabled x-ray source can allow the x-ray tube 15 to be inserted into a smaller space, but the cable can add extra weight to the x-ray source, so rigid mounting may be preferable if there is no need to insert the x-ray tube 15 into a smaller space.

What is claimed is:

1. An x-ray tube comprising:

a cathode and an anode electrically insulated from one another, the anode including a proximal end closer to the cathode and a distal end farther from the cathode;

an x-ray window configured to allow transmission of x-rays, the x-ray window spaced apart from the anode;

the cathode configured to emit electrons in an electron beam towards the anode, the anode including target material at the proximal end configured to emit x-rays in response to impinging electrons from the cathode, the x-rays emitted in an x-ray beam through an internal cavity of the x-ray tube to and through the x-ray window;

an axis along a center of the electron beam defining an electron-beam axis; an axis along a longest dimension of the anode, defining an anode axis; and an axis perpendicular to a plane of the x-ray window and along a center of the x-ray beam, defining an x-ray axis;

an angle between the electron-beam axis and the anode axis being ≥10° and ≤80° and an angle between the anode axis and the x-ray axis being ≥10° and ≤80°; and a cap on the anode at the proximal end, the cap including: an internal cavity, defining a cap cavity; a first hole, defining an electron-beam hole, extending from an exterior of the cap to the cap cavity along the electron-beam axis; a second hole, defining an anode hole, extending from the exterior of the cap to the cap cavity along the anode axis, the anode located in the anode hole with the target material facing the cap cavity; and a third hole, defining an x-ray hole, extending from the exterior of the cap to the cap cavity along the x-ray axis.

2. The x-ray tube of claim 1, wherein an angle between a plane of a face of the anode with the target material and the x-ray axis is ≥2° and ≤20°.

3. The x-ray tube of claim 1, wherein the angle between the electron-beam axis and the anode axis is ≥30° and ≤60°; the angle between the anode axis and the x-ray axis is ≥30° and ≤60°; and an angle between the electron-beam axis and the x-ray axis is ≥60° and ≤120°.

4. The x-ray tube of claim 1, wherein the anode has at least 50 weight percent of materials having an atomic number of at least 42; a coefficient of thermal expansion of ≤12 m/(m*K); and a thermal conductivity of ≥140 W/(m*K).

5. The x-ray tube of claim 1, wherein:

the anode further comprises a cavity at the distal end, defining an anode cavity, and the anode being electrically conductive from the target material to the anode cavity; and the anode cavity being sized and shaped for insertion of an electrical connector.

6. The x-ray tube of claim 1, wherein a material composition of the anode includes at least 70% tungsten and at least 5% copper.

7. The x-ray tube of claim 5, wherein the anode cavity has a cylindrical shape.

8. The x-ray tube of claim 5, wherein a length of the anode cavity in a direction parallel to the anode axis is between 5 mm and 100 mm and a width of the anode cavity in a direction perpendicular to the anode axis is between 0.5 mm and 8 mm.

9. The x-ray tube of claim 5, wherein the x-ray tube forms part of an x-ray source, the x-ray source further comprising a power supply rigidly mounted to the x-ray tube, the power supply including the electrical connector rigidly connected to and extending from a circuit board into the anode cavity and making electrical contact with the anode.

10. The x-ray source of claim 9, wherein:

the power supply is battery operated and the x-ray source is portable with a weight of less than 3 kilograms; and the circuit board includes a voltage multiplier circuit configured to provide electrical power to the electrical connector with a voltage of at least 4 kilovolts.

11. The x-ray source of claim 10, further comprising a distance of at least 40 mm between any part of the voltage multiplier circuit, having a voltage differential of at least 5000 volts with respect to ground, and a mounting bolt at ground voltage.

12. The x-ray tube of claim 5, wherein a material composition of the cap is the same as a material composition of the anode.

13. An x-ray tube comprising:

a cathode and an anode electrically insulated from one another, the anode including a proximal end closer to the cathode and a distal end farther from the cathode;

an x-ray window configured to allow transmission of x-rays, the x-ray window spaced apart from the anode;

the cathode configured to emit electrons in an electron beam towards the anode, the anode including target material at the proximal end configured to emit x-rays in response to impinging electrons from the cathode, the x-rays emitted through an Internal cavity of the x-ray tube to and through the x-ray window;

an axis along a center of the electron beam, defining an electron-beam axis; an axis along a longest dimension of the anode, defining an anode axis; and an axis perpendicular to a plane of the x-ray window and along a center of emitted x-rays defining an x-ray axis;

a cap on the proximal end of the anode, the cap including:

an internal cavity, defining a cap cavity;

a first hole, defining an electron-beam hole, extending from an exterior of the cap to the cap cavity along the electron-beam axis;

a second hole, defining an anode hole, extending from the exterior of the cap to the cap cavity along the anode axis, the anode located in the anode hole with the target material facing the cap cavity; and a third hole, defining an x-ray hole, extending from the exterior of the cap to the cap cavity along the x-ray axis.

14. The x-ray tube of claim 13, wherein an angle between the electron-beam axis and the anode axis is ≥30° and ≤60°; an angle between the anode axis and the x-ray axis is ≥30° and ≤60°; and an angle between the electron-beam axis and the x-ray axis is ≥60° and ≤120°.

15. The x-ray tube of claim 14, wherein an angle between a plane of a face of the anode with the target material and the x-ray axis is ≥2° and ≤20°.

16. The x-ray tube of claim 13, wherein the x-ray hole has an expanding size such that a largest dimension of the x-ray hole at the exterior of the cap is at least 1.5 times larger than a largest dimension of the x-ray hole at the cap cavity.

17. The x-ray tube of claim 13, wherein the exterior of the cap, except for an entrance to the anode hole, consists of smooth curves.

18. The x-ray tube of claim 13, wherein the exterior of the cap has a rounded convex shape.

19. The x-ray tube of claim 13, wherein:

the anode has at least 50 weight percent of materials having an atomic number of at least 42; a coefficient of thermal expansion of ≤12 m/(m*K); and a thermal conductivity of ≥140 W/(m*K); and the cap has at least 50 weight percent of materials having an atomic number of at least 42.

20. The x-ray tube of claim 13, wherein a material composition of the cap is the same as a material composition of the anode.

* * * * *